US010295253B2

(12) United States Patent
Davidian

(10) Patent No.: US 10,295,253 B2
(45) Date of Patent: May 21, 2019

(54) METHOD AND DEVICE FOR SEPARATING AIR BY CRYOGENIC DISTILLATION

(71) Applicant: L'Air Liquide, Societe Anonyme Pour l'Etude et l'Exploitation des Procedes Georges Claude, Paris (FR)

(72) Inventor: Benoit Davidian, Saint Maur des Fosses (FR)

(73) Assignee: L'Air Liquide Societe Anonyme Pour L'Etude Et L'Exploitation Des Procedes Georges Claude, Paris (FR)

( * ) Notice: Subject to any disclaimer, the term of this patent is extended or adjusted under 35 U.S.C. 154(b) by 412 days.

(21) Appl. No.: 15/027,826

(22) PCT Filed: Oct. 14, 2014

(86) PCT No.: PCT/FR2014/052607
§ 371 (c)(1),
(2) Date: Apr. 7, 2016

(87) PCT Pub. No.: WO2015/055939
PCT Pub. Date: Apr. 23, 2015

(65) Prior Publication Data

US 2016/0245586 A1 Aug. 25, 2016

(30) Foreign Application Priority Data

Oct. 15, 2013 (FR) ..... 13 60002

(51) Int. Cl.
*F25J 3/00* (2006.01)
*F25J 3/04* (2006.01)

(52) U.S. Cl.
CPC ..... *F25J 3/04454* (2013.01); *F25J 3/0406* (2013.01); *F25J 3/0409* (2013.01);
(Continued)

(58) Field of Classification Search
CPC .. F25J 2200/08; F25J 2200/10; F25J 2200/50; F25J 3/0409; F25J 3/0405;
(Continued)

(56) References Cited

U.S. PATENT DOCUMENTS 5,341,646 A * 8/1994 Agrawal ..... F25J 3/0409 62/646
5,675,977 A 10/1997 Prosser
(Continued)

FOREIGN PATENT DOCUMENTS

EP 0 538 118 4/1993
FR 2 930 328 10/2009

OTHER PUBLICATIONS

International Search Report and Written Opinion for PCT/FR2014/052607, dated Oct. 14, 2015.
(Continued)

*Primary Examiner* — Keith M Raymond
(74) *Attorney, Agent, or Firm* — Justin K. Murray

(57) ABSTRACT

The invention relates to a method for separating air by cryogenic distillation in a set of columns including a first column operating at a first pressure, a second column operating at a second pressure which is lower than the first pressure, and a third column operating at a third pressure, which is lower than the second pressure, wherein the third column includes first and second evaporator-condensers, and nitrogen from a cold compressor is sent to one of the evaporator-condensers.

17 Claims, 1 Drawing Sheet

(52) U.S. Cl.
CPC ..... *F25J 3/04187* (2013.01); *F25J 3/04387* (2013.01); *F25J 3/04442* (2013.01); *F25J 3/04448* (2013.01); *F25J 2200/08* (2013.01); *F25J 2200/10* (2013.01); *F25J 2200/20* (2013.01); *F25J 2200/50* (2013.01); *F25J 2200/54* (2013.01); *F25J 2210/06* (2013.01); *F25J 2235/42* (2013.01); *F25J 2240/10* (2013.01); *F25J 2240/42* (2013.01); *F25J 2245/42* (2013.01); *F25J 2290/12* (2013.01)

(58) Field of Classification Search
CPC .. F25J 2200/54; F25J 3/04024; F25J 2210/06; F25J 3/04436; F25J 3/04442; F25J 3/04448; F25J 3/04454
See application file for complete search history.

(56) References Cited

U.S. PATENT DOCUMENTS

| | | | | |
|---|---|---|---|---|
| 6,286,336 | B1 | 9/2001 | Prosser | |
| 2008/0115531 | A1* | 5/2008 | Ha | F25J 3/0406 62/620 |
| 2011/0067445 | A1* | 3/2011 | Davidian | F25J 3/0406 62/652 |

OTHER PUBLICATIONS

French Search Report and Written Opinion for FR 1 360 002, dated Jun. 27, 2014.

* cited by examiner

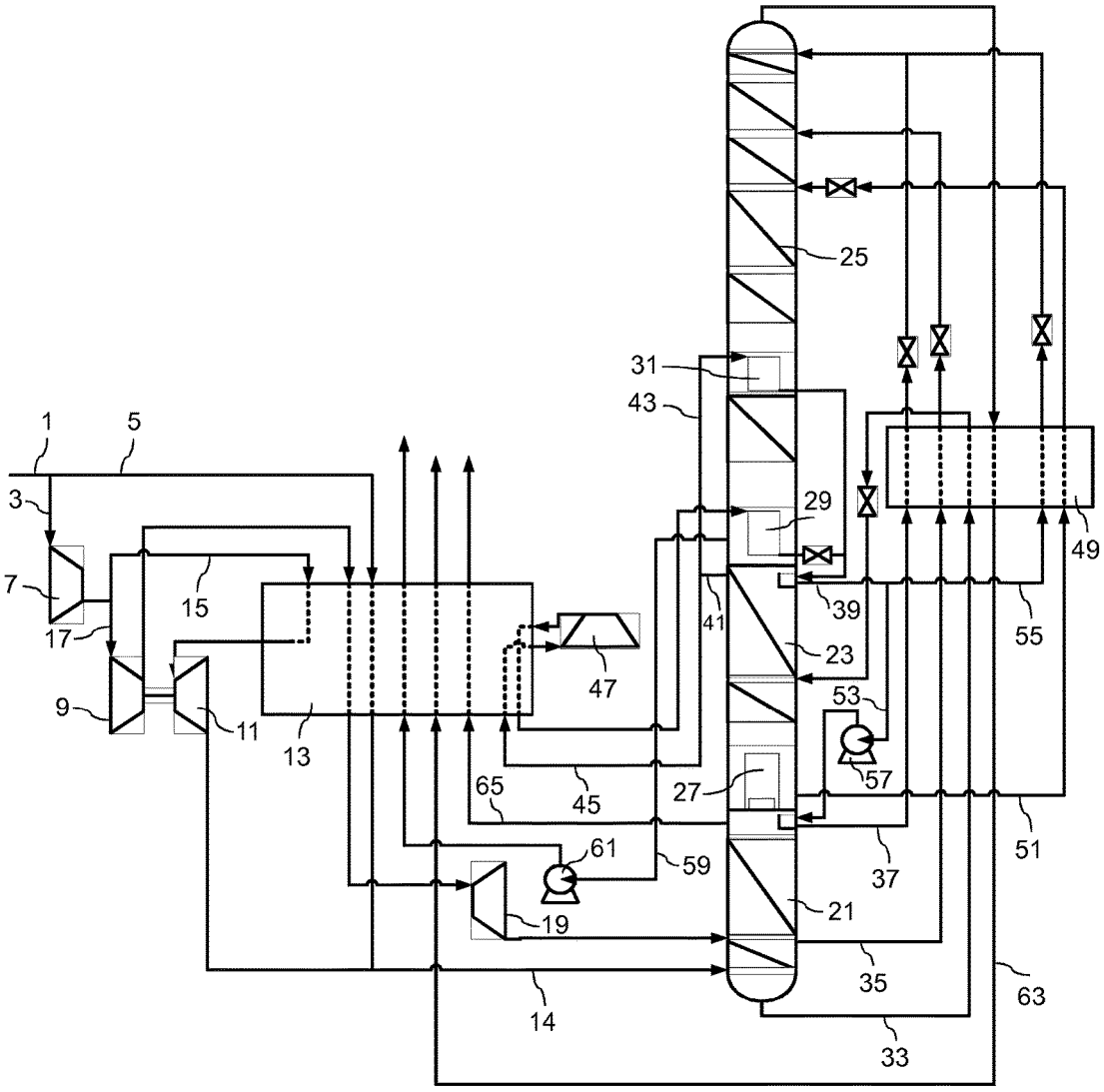
1
5
3
7
17
15
9
11
13
14
19
61
59
65
45
47
41
31
43
29
27
25
23
21
39
53
57
37
35
33
55
49
51
63

METHOD AND DEVICE FOR SEPARATING AIR BY CRYOGENIC DISTILLATION

CROSS REFERENCE TO RELATED APPLICATIONS

This application is a § 371 of International PCT Application PCT/FR2014/052607, filed Oct. 14, 2014, which claims the benefit of FR1360002, filed Oct. 15, 2013, both of which are herein incorporated by reference in their entireties.

TECHNICAL FIELD OF THE INVENTION

The present invention relates to a process and unit for separating air by cryogenic distillation.

BACKGROUND OF THE INVENTION

Within the context of supplying oxygen to gasification processes, the consumption of impure oxygen (typically of the order of 95 mol %) which is pressurized (typically 50 bara and above) is accompanied by a consumption of pressurized nitrogen for the gasifier and for the associated gas turbine.

When the client recycles all of the available pressurized nitrogen, layouts with a pressurized low-pressure column make it possible to obtain a good oxygen separation energy. A low-pressure column is said to be "pressurized" when it operates at a pressure of greater than 2 bar abs.

SUMMARY OF THE INVENTION

It is proposed to improve the efficiency of such a system via a more thorough thermal integration between columns.

The invention is particularly advantageous in layouts which naturally have a disparate hot end of the exchange line or if there is refrigerating capacity to be recycled.

A typical hot-end difference for a process in which this invention would be used would be between 6 and 10° C.

U.S. Pat. No. 5,341,646 describes a separation unit comprising three columns, a high-pressure column, a low-pressure column and an intermediate-pressure column operating at a pressure between the low pressure and the high pressure.

Air is sent to the high-pressure column and nitrogen from the top of the high-pressure column is condensed in an intermediate condenser of the intermediate-pressure column. A cycle nitrogen stream is condensed in the bottom condenser of the intermediate-pressure column. Gaseous nitrogen is produced at the top of the intermediate column.

The nitrogen from the top of the intermediate-pressure column is condensed in the bottom of the low-pressure column and liquid oxygen originating from the low-pressure column is pressurized and is vaporized in the exchange line.

U.S. Pat. No. 6,286,336 and U.S. Pat. No. 5,675,977 describe the prior art closest to this invention.

According to one subject of the invention, a process is provided for separating air by cryogenic distillation in a set of columns comprising a first column operating at a first pressure, a second column operating at a second pressure lower than the first pressure and a third column operating at a third pressure lower than the second pressure, wherein:

i) compressed, purified and cooled air is sent to the first column where it is separated in order to form an oxygen-enriched liquid and a nitrogen-enriched gas, ii) a portion of the nitrogen-enriched gas from the first column is condensed in a bottom vaporizer-condenser of the second column, iii) oxygen-enriched liquid is sent from the first column to the second column, iv) an oxygen-enriched liquid is sent from the bottom of the second column to the third column, v) a nitrogen-enriched gas is sent from the top of the second column to a first vaporizer-condenser of the third column where it is condensed, the condensed liquid being sent back to the second column, vi) a nitrogen-rich gas is withdrawn from the top of the third column, vii) a liquid containing at least 85% oxygen is withdrawn from the bottom of the third column, pressurized and vaporized in order to form a gaseous product containing at least 85% oxygen, wherein the first vaporizer-condenser of the third column is a vaporizer-condenser positioned at an intermediate point of the third column, the third column has a second vaporizer-condenser which is a bottom vaporizer-condenser, a nitrogen-enriched gas from the second column is compressed in a compressor having an inlet temperature below ambient temperature and is sent to the second vaporizer-condenser in order to be condensed therein, the vaporizer-condenser of the second column is a bottom vaporizer-condenser which is the only vaporizer-condenser present in the second column, the overhead gas from the first column is sent to the vaporizer-condenser of the second column without having been compressed, optionally a nitrogen-rich liquid is pressurized then sent from the top of the second column to the top of the first column and gaseous nitrogen is withdrawn from the top of the first column and reheated to form a product of the process.

According to other optional features:

- an intermediate liquid is sent from the first column to the third column;
- all the nitrogen-enriched gas from the top of the second column is sent to the first and second vaporizer-condensers;
- the liquid containing at least 85% oxygen is pressurized to a pressure greater than 30 bar abs, preferably greater than 40 bara before being vaporized or pseudo-vaporized;
- the third pressure is greater than 2 bar abs;
- the compressor having an inlet temperature below ambient temperature has an inlet temperature above the vaporization temperature of the liquid containing at least 85% oxygen minus 5° C.;
- the liquid containing at least 85% oxygen is vaporized in a heat exchanger where the compressed air is cooled, the difference in temperatures at the hot end of the heat exchanger being less than 10° C., preferably less than 6° C.

According to another subject of the invention, a unit is provided for separating air by cryogenic distillation comprising a set of columns comprising a first column operating at a first pressure, a second column operating at a second pressure lower than the first pressure and a third column operating at a third pressure lower than the second pressure, the second column having a bottom vaporizer-condenser, the third column having a first vaporizer-condenser, a line for sending compressed, purified and cooled air to the first column where it is separated in order to form an oxygen-enriched liquid and a nitrogen-enriched gas, a line for sending a portion of the nitrogen-enriched gas from the first column to be condensed in the bottom vaporizer-condenser of the second column, a line for sending oxygen-enriched liquid from the first column to the second column, a line for sending an oxygen-enriched liquid from the bottom of the second column to the third column, a line for sending a nitrogen-enriched gas from the top of the second column to a first vaporizer-condenser of the third column where it is condensed, a line for sending the condensed liquid from the first vaporizer-condenser to the second column, a line for withdrawing a nitrogen-rich gas from the top of the third column, a line for withdrawing a liquid containing at least 85% oxygen from the bottom of the third column, means for pressurizing the liquid and a heat exchanger for vaporizing the pressurized liquid in order to form a gaseous product containing at least 85% oxygen, characterized in that the first vaporizer-condenser of the third column is a vaporizer-condenser positioned at an intermediate point of the third column, the third column has a second vaporizer-condenser which is a bottom vaporizer-condenser, a nitrogen-enriched gas from the second column is compressed in a compressor having an inlet temperature below ambient temperature and is sent to the second vaporizer-condenser in order to be condensed therein, the vaporizer-condenser of the second column is a bottom vaporizer-condenser which is the only vaporizer-condenser present in the second column, the unit comprises means for sending the overhead gas from the first column to the vaporizer-condenser of the second column without having been compressed, optionally means for pressurizing a nitrogen-rich liquid and means for sending the pressurized rich liquid from the top of the second column to the top of the first column, and a line for withdrawing a nitrogen enriched gas from the top of the first column and means for reheating it in order to form a product of the process.

The unit may comprise means for sending an intermediate liquid from the first column to the third column.

The unit may comprise means for sending all the nitrogen-enriched gas from the top of the second column to the first and second vaporizer-condensers.

The use of the cold compressor makes it possible to greatly reduce, by cascade effect, the pressure of the first column, which allows a substantial energy saving.

BRIEF DESCRIPTION OF THE DRAWINGS

These and other features, aspects, and advantages of the present invention will become better understood with regard to the following description, claims, and accompanying drawings. It is to be noted, however, that the drawings illustrate only several embodiments of the invention and are therefore not to be considered limiting of the invention's scope as it can admit to other equally effective embodiments.

The Figure represents a process flow diagram in accordance with an embodiment of the present invention.

DETAILED DESCRIPTION

The invention will be described in greater detail with reference to the figure.

The air separation unit comprises a heat exchanger 13, a heat exchanger 49, a first column 21 operating at a first pressure between 11 and 20 bara, a second column 23 operating at a second pressure lower than the first pressure and between 1 and 11 bara and a third column 25 operating at a third pressure lower than the second pressure. The third pressure is between 2 bar abs and 6 bara.

The air 1 is compressed to the first pressure and then split into two. One portion 5 at the first pressure is cooled in the exchanger 13 and is sent to the first column 21 in gaseous form. The remainder 3 is boosted in the booster 7 up to a pressure of 49 bara and split into two. One portion 15 is sent to the exchanger 13 where it is cooled to an intermediate temperature of the exchanger then expanded in a Claude turbine 11 and sent to the column 21 after being mixed with the stream 5 in order to form the stream 14. The remainder 17 of the boosted air is again boosted in a booster 9 coupled to the turbine 11 and sent to the exchanger 13 where it is cooled. The cooled and pseudo-liquefied stream 17 is expanded in a turbine 19 in order to form an at least partially liquid stream which is sent to the column 21. All the air 1 is sent to the column 21 where it is separated.

An oxygen-enriched stream 33 is sent from the first column to the middle of the second column 23 after expansion. An intermediate stream 35 is sent from the first column to the third column 25 after subcooling in 49, then expansion. Liquid nitrogen from the top of the first column 21 is subcooled, then expanded and sent to the top of the third column 25 after subcooling in 49, then expansion. Gaseous nitrogen 65 is withdrawn from the first column and reheated in the exchanger 13 in order to form a nitrogen product which is pressurized between 11 and 20 bara.

Another portion of the nitrogen is condensed in the bottom vaporizer-condenser 27 of the second column and is sent back to the top of the first column.

A bottom liquid 51 from the second column 23 is subcooled, then expanded and sent to an intermediate level of the third column 25. An overhead liquid 39 from the second column 23 is split into two, one portion 55 being subcooled, then expanded and sent to the top of the third column 25 and the remainder 53 being pressurized by a pump 57 in order to be sent back to the top of the first column 21. An overhead gas 41 from the second column 23 is split into two. One portion 43 is sent to a first vaporizer-condenser 31 which is located at an intermediate level of the third column 25. The portion 43 is condensed therein and is sent to the top of the second column 23. The other portion 45 of the gas 41 is sent back to the heat exchanger 13 where it is reheated to a temperature of −120° C. The portion 45 is reheated to a temperature above the vaporization temperature of the liquid 59 minus 5° C. In this example, the portion 45 is at a temperature level no more than 5° C. below the vaporization plateau of the pressurized oxygen. The portion 45 may also be at a temperature level above this plateau. Next, the gas 45 is compressed in a compressor 47, sent back to the exchanger 13 where it is cooled down to the cold end and sent to the second vaporizer-condenser 29 which is a bottom vaporizer-condenser of the third column 25. The portion 45 is condensed in the vaporizer-condenser 29 and the condensed stream is expanded and sent to the top of the second column 23.

An overhead gas 63 is withdrawn from the top of the third column 25 and is reheated in the exchangers 49, 13 in order to act as waste gas. The bottom liquid 59 from the third column 25 contains at least 85 mol % oxygen, or even at least 95 mol % oxygen but less than 98% oxygen. This liquid 59 is pressurized by the pump 61 to a pressure of at least 30 bar abs and is then vaporized (or pseudo-vaporized if its pressure is supercritical) in the exchanger 13 in order to form a pressurized oxygen stream to be sent to the gasifier.

The difference in temperatures at the hot end of the heat exchanger 13 being less than 10° C., preferably less than 6° C., for example between 2° C. and 3° C.

While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims. The present invention may suitably comprise, consist or consist essentially of the elements disclosed and may be practiced in the absence of an element not disclosed. Furthermore, if there is language referring to order, such as first and second, it should be understood in an exemplary sense and not in a limiting sense. For example, it can be recognized by those skilled in the art that certain steps can be combined into a single step.

The singular forms "a", "an" and "the" include plural referents, unless the context clearly dictates otherwise.

"Comprising" in a claim is an open transitional term which means the subsequently identified claim elements are a nonexclusive listing (i.e., anything else may be additionally included and remain within the scope of "comprising"). "Comprising" as used herein may be replaced by the more limited transitional terms "consisting essentially of" and "consisting of" unless otherwise indicated herein.

"Providing" in a claim is defined to mean furnishing, supplying, making available, or preparing something. The step may be performed by any actor in the absence of express language in the claim to the contrary.

Optional or optionally means that the subsequently described event or circumstances may or may not occur. The description includes instances where the event or circumstance occurs and instances where it does not occur.

Ranges may be expressed herein as from about one particular value, and/or to about another particular value. When such a range is expressed, it is to be understood that another embodiment is from the one particular value and/or to the other particular value, along with all combinations within said range.

All references identified herein are each hereby incorporated by reference into this application in their entireties, as well as for the specific information for which each is cited.

The invention claimed is:

1. A process for separating air by cryogenic distillation in a set of columns comprising a first column operating at a first pressure, a second column operating at a second pressure lower than the first pressure, and a third column operating at a third pressure lower than the second pressure, the process comprising the steps of:

i) sending compressed, purified and cooled air to the first column for separation therein to form an oxygen-enriched liquid and a nitrogen-enriched gas;

ii) condensing a first portion of the nitrogen-enriched gas from the first column in a bottom vaporizer-condenser of the second column wherein the first portion of the nitrogen-enriched gas from the first column is sent to the bottom vaporizer-condenser of the second column without having been compressed;

iii) sending the oxygen-enriched liquid from the first column to the second column;

iv) sending a second oxygen-enriched liquid from the bottom of the second column to the third column;

v) sending a second nitrogen-enriched gas from the top of the second column to a first vaporizer-condenser of the third column wherein the second nitrogen-enriched gas is condensed within the first vaporizer-condenser of the third column and then sent to the second column;

vi) withdrawing a nitrogen-rich gas from a top portion of the third column;

vii) withdrawing a liquid containing at least 85% oxygen from the bottom of the third column, and then pressurizing and vaporizing the liquid containing at least 85% oxygen to form a gaseous product containing at least 85% oxygen, wherein the first vaporizer-condenser of the third column is a vaporizer-condenser positioned at an intermediate point of the third column, the third column has a second vaporizer-condenser which is a bottom vaporizer-condenser, a third nitrogen-enriched gas from the second column is compressed in a compressor having an inlet temperature below ambient temperature and is sent to the second vaporizer-condenser to be condensed therein, the vaporizer-condenser of the second column is disposed in the bottom section of the second column and is the only vaporizer-condenser present in the second column.

2. The process as claimed in claim 1, wherein an intermediate liquid is sent from the first column to the third column.

3. The process as claimed in claim 1, wherein a nitrogen-rich liquid from top second is pressurized, and then sent to the top of the first column, and a second portion of the nitrogen-enriched gas from the top of the first column is withdrawn and reheated to form a product of the process.

4. The process as claimed in claim 1, wherein all the nitrogen-enriched gas from the top of the second column is sent to the first and second vaporizer-condensers.

5. The process as claimed in claim 1, wherein the liquid containing at least 85% oxygen is pressurized to a pressure greater than 30 bar abs before being vaporized or pseudo-vaporized.

6. The process as claimed in claim 1, wherein the liquid containing at least 85% oxygen is pressurized to a pressure greater than 40 bar abs before being vaporized or pseudo-vaporized.

7. The process as claimed in claim 1, wherein the third pressure is greater than 2 bar abs.

8. The process as claimed in claim 1, wherein the compressor having an inlet temperature below ambient temperature has an inlet temperature above a temperature that is 5 degrees below the vaporization temperature of the liquid containing at least 85% oxygen.

9. The process as claimed in claim 1, further comprising the step of cooling a compressed, purified air in a heat exchanger to form the compressed, purified and cooled air wherein the compressed, purified air enters the heat exchanger at an entrance temperature, wherein the liquid containing at least 85% oxygen is vaporized in the heat exchanger and exits the heat exchanger at an exit temperature wherein the difference between the entrance temperature of the compressed, purified air and the exit temperature of the vaporized liquid containing at least 85% oxygen is less then 10° C.

10. The process as claimed in claim 9, wherein the difference between the entrance temperature of the compressed, purified air and the exit temperature of the vaporized liquid containing at least 85% oxygen is less than 6° C.

11. A unit for separating air by cryogenic distillation comprising:

a set of columns comprising a first column operating at a first pressure, a second column operating at a second pressure lower than the first pressure, and a third column operating at a third pressure lower than the second pressure, the second column having a bottom vaporizer-condenser, the third column having a first vaporizer-condenser and a second vaporizer-condenser, wherein the first vaporizer-condenser of the third column is positioned at an intermediate point of the third column, wherein the second vaporizer-condenser is positioned at a bottom location of the third column;

a first line configured to send compressed, purified and cooled air to the first column where the compressed, purified and cooled air is separated to form an oxygen-enriched liquid and a nitrogen-enriched gas;

a second line configured to send a first portion of the nitrogen-enriched gas from the first column to be condensed in the bottom vaporizer-condenser of the second column, wherein there is an absence of a means for compression of the first portion of the nitrogen-enriched gas between the first column and the bottom vaporizer-condenser of the second column;

a third line configured to send the oxygen-enriched liquid from the first column to the second column;

a fourth line configured to send a second oxygen-enriched liquid from the bottom of the second column to the third column;

a fifth line configured to send a second nitrogen-enriched gas from the top of the second column to the first vaporizer-condenser of the third column where the second nitrogen-enriched gas is condensed to form a nitrogen-enriched liquid;

a sixth line configured to send the nitrogen-enriched liquid from the first vaporizer-condenser to the column;

a seventh line configured to withdraw a nitrogen-rich gas from the top of the third column;

an eigth line configured to withdraw a liquid containing at least 85% oxygen from the bottom of the third column;

a first means for pressurizing the liquid containing at least 85% oxygen and a heat exchanger for vaporizing the pressurized liquid containing at least 85% oxygen to form a gaseous product containing at least 85% oxygen;

a compressor configured to receive and compress a third nitrogen-enriched gas from the second column, wherein the compressor is in fluid communication with an intermediate portion of the heat exchanger, and wherein, during operation, the compressor has an inlet temperature below ambient temperature, wherein the second vaporizer-condenser is in fluid communication with the compressor such that the second vaporizer-condenser is configured to receive and condense a compressed nitrogen-enriched gas from the compressor after the compressed nitrogen-enriched gas is cooled in the heat exchanger to form a condensed nitrogen-enriched stream, wherein the bottom vaporizer-condenser of the second column is is the only vaporizer-condenser present in the second column;

a second means for pressurizing and sending a rich liquid from the top of the second column to the top of the first column; and a ninth line configured to withdraw a second portion of the nitrogen enriched gas from the top of the first column and the heat exchanger is further configured for reheating the second portion of the nitrogen enriched gas from the top of the first column to from a product of the process.

12. The unit as claimed in claim 11, comprising a first means for sending an intermediate liquid from the first column to the third column.

13. The unit as claimed in claim 11, comprising a second means for sending all the nitrogen-enriched gas from the top of the second column to the first and second vaporizer-condensers.

14. The unit as claimed in claim 11, wherein the first means pressurizes the liquid containing at least 85% oxygen to a pressure greater than 30 bar abs before the liquid containing at least 85% oxygen is vaporized or pseudo-vaporized.

15. The unit as claimed in claim 14, wherein the first means for pressurizing pressurizes the liquid containing at least 85% oxygen to a pressure greater than 40 bar abs before the liquid containing at least 85% oxygen is vaporized or pseudo-vaporized.

16. The unit as claimed in claim 11, wherein the heat exchanger is in fluid communication with a source for compressed, purified air, wherein the heat exchanger is in the fluid communication with the first means for pressurizing the liquid containing at least 85% oxygen.

17. The unit as claimed in claim 11, further comprising a liquid nitrogen pump in fluid communication with the second column and the first column.

* * * * *